US006863738B2

(12) United States Patent
Kool et al.

(10) Patent No.: US 6,863,738 B2
(45) Date of Patent: Mar. 8, 2005

(54) METHOD FOR REMOVING OXIDES AND COATINGS FROM A SUBSTRATE

(75) Inventors: Lawrence Bernard Kool, Clifton Park, NY (US); James Anthony Ruud, Delmar, NY (US)

(73) Assignee: General Electric Company, Schenectady, NY (US)

( * ) Notice: Subject to any disclaimer, the term of this patent is extended or adjusted under 35 U.S.C. 154(b) by 9 days.

(21) Appl. No.: 09/771,186

(22) Filed: Jan. 29, 2001

(65) Prior Publication Data

US 2002/0100493 A1 Aug. 1, 2002

(51) Int. Cl.[7] ..... B08B 7/00
(52) U.S. Cl. ..... 134/3; 134/41
(58) Field of Search ..... 216/96, 97, 100, 216/101, 102, 103, 104, 108, 109; 134/1, 2, 3, 41; 252/79.2, 79.3; 510/255, 269, 405

(56) References Cited

U.S. PATENT DOCUMENTS

| | | | | |
|---|---|---|---|---|
| 2,726,180 | A | * 12/1955 | Stankey | 134/22.1 |
| 3,062,748 | A | * 11/1962 | Harrison | 507/244 |
| 3,106,499 | A | * 10/1963 | Kendall | 216/104 |
| 3,373,114 | A | 3/1968 | Grunwald | 252/136 |
| 3,458,353 | A | 7/1969 | Baldi | 134/3 |
| 3,514,407 | A | 5/1970 | Missel | |
| 3,607,398 | A | 9/1971 | Lucas | 134/3 |
| 3,622,391 | A | 11/1971 | Baldi | 134/3 |
| 3,684,719 | A | * 8/1972 | Frey | 252/79.3 |
| 3,779,879 | A | 12/1973 | Scott | 204/146 |
| 3,833,414 | A | 9/1974 | Grisik et al. | 134/3 |
| 3,922,390 | A | 11/1975 | Otnalek et al. | 427/162 |
| 3,956,147 | A | * 5/1976 | Becker et al. | 423/19 |
| 3,986,970 | A | 10/1976 | Shiga | |
| 4,004,956 | A | 1/1977 | Brindisi, Jr. | |
| 4,339,282 | A | 7/1982 | Lada et al. | 134/3 |
| 4,425,185 | A | 1/1984 | Fishter et al. | 156/656 |
| 4,551,434 | A | * 11/1985 | Thoma | 436/5 |
| 4,838,957 | A | 6/1989 | Miyamoto et al. | |
| 5,030,323 | A | * 7/1991 | Awad | 134/3 |
| 5,064,500 | A | * 11/1991 | Awad | 134/3 |
| 5,120,605 | A | * 6/1992 | Zuel et al. | 216/97 |
| 5,227,016 | A | * 7/1993 | Carlson et al. | 216/99 |
| 5,244,512 | A | * 9/1993 | Kawasaki et al. | 148/260 |
| 5,306,526 | A | * 4/1994 | Gray et al. | 427/309 |
| 5,356,490 | A | * 10/1994 | Dolan et al. | 148/247 |
| 5,534,082 | A | * 7/1996 | Dollman et al. | 148/247 |
| 5,585,086 | A | 12/1996 | McCullough et al. | 423/658.5 |
| 5,637,252 | A | * 6/1997 | Johnson et al. | 134/3 |
| 5,769,967 | A | * 6/1998 | Dolan | 148/247 |
| 5,817,182 | A | * 10/1998 | O'Brien | 134/1.3 |
| 6,261,969 | B1 | * 7/2001 | Matsuno et al. | 252/79.1 |
| 6,274,027 | B1 | * 8/2001 | Kiya et al. | 205/705 |
| 6,420,178 | B1 | * 7/2002 | LaGraff et al. | 436/2 |
| 6,494,960 | B1 | 12/2002 | Macdonald et al. | |
| 2002/0100493 | A1 | * 8/2002 | Kool et al. | 134/3 |
| 2003/0062271 | A1 | * 4/2003 | Kool et al. | 205/717 |

FOREIGN PATENT DOCUMENTS

| | | |
|---|---|---|
| EP | 1162286 | * 12/2001 |
| GB | 2115013 A | 9/1983 |
| JP | 56096083 | * 8/1981 |
| JP | 56166386 | * 12/1981 |
| WO | WO9113186 | 9/1991 |
| WO | WO9303198 | 2/1993 |

* cited by examiner

*Primary Examiner*—Alexander Markoff
(74) *Attorney, Agent, or Firm*—Cantor Colburn LLP

(57) ABSTRACT

A method for selectively removing oxide material from the surface of a substrate or coating disposed on the substrate is disclosed. The method includes the step of contacting the oxide material with an aqueous treatment composition having the formula $H_xAF_6$, wherein A can be Si, Ge, Ti, Zr, Al, and Ga; and x is 1–6. The composition can sometimes include an additional acid, such as phosphoric acid, nitric acid, sulfuric acid, hydrochloric acid, hydrofluoric acid, and mixtures thereof. A method for replacing a worn or damaged protective coating applied over a substrate, utilizing the treatment composition, is also described.

28 Claims, 4 Drawing Sheets

METHOD FOR REMOVING OXIDES AND COATINGS FROM A SUBSTRATE

BACKGROUND OF THE INVENTION

In a general sense, this invention relates to methods for removing material applied to or formed over a metal substrate. More specifically, it relates to methods for removing an oxide material which is disposed on a substrate, or on a coating applied over the substrate.

Metal alloys are often used in industrial environments which include extreme operating conditions. As an example, gas turbine engines are often subjected to repeated thermal cycling during operation. The standard operating temperature of turbine engines continues to be increased, to achieve improved fuel efficiency. The turbine engine components (and other industrial parts) are often formed of superalloys, which can withstand a variety of extreme operating conditions. However, they often must be covered with coatings which protect them from environmental degradation, e.g., the adverse effects of corrosion and oxidation. Current coatings used on components in gas turbine hot sections, such as blades, nozzles, combustors, and transition pieces, generally belong to one of two classes: diffusion coatings or overlay coatings.

State-of-the-art diffusion coatings are generally formed of aluminide-type alloys, such as nickel-aluminide; a noble metal-aluminide such as platinum aluminide; or nickel-platinum-aluminide. Overlay coatings typically have the composition MCrAl(X), where M is an element selected from the group consisting of Ni, Co, Fe, and combinations thereof, and X is an element selected from the group consisting of Y, Ta, Si, Hf, Ti, Zr, B, C, and combinations thereof. Diffusion coatings are formed by depositing constituent components of the coating, and reacting those components with elements from the underlying substrate, to form the coating by high temperature diffusion. In contrast, overlay coatings are generally deposited intact, without reaction with the underlying substrate.

During service, diffusion and overlay coatings on a component are often exposed to oxidative conditions. For example, coatings on turbine airfoils are typically subjected to oxidation in the hot gas path during normal operation. Under such conditions, which often include temperatures in the range of about 1400–2100° F. (about 760–1149° C.), various oxidative products (mainly thermally-grown oxide or "TGO") are formed on the coatings. For example, aluminum oxides (especially $\alpha$-aluminum oxides) often form on platinum-aluminide coatings. Aluminum oxides, chromium oxides, and various spinels often form on the MCrAl (X)-type coatings.

When turbine engine components are overhauled, the protective coatings are often removed to allow inspection and repair of the underlying substrate. Various stripping compositions have been used to remove the coatings. Usually, the oxide materials must be removed before the coatings can be treated with the stripping composition.

In past practice, oxide removal in this situation has been carried out as a separate step, prior to removal of the underlying coating. Various techniques have been used for oxide removal. For example, the oxide materials have often been removed from external sections of the turbine component by grit blasting.

As an alternative, the turbine component has sometimes been treated in an oxide-removal solution, i.e., one separate from the stripping composition used to subsequently remove the protective coating. These solutions have usually been based on strong mineral acids or strong caustics. Examples of the mineral acids are hydrochloric acid, sulfuric acid, and nitric acid. The caustic solutions usually include sodium hydroxide, potassium hydroxide, or various molten salts. Repeated treatments sometimes have to be used to remove the oxide. After removal of the oxide is completed, the substrate is then typically immersed in another solution—one that is suitable for removing the coating material itself.

These oxide removal techniques are sometimes effective, but there are often drawbacks to their use. For example, grit blasting is a labor-intensive process that is usually carried out on a piece-by-piece basis. Special care must sometimes be taken, to prevent grit-blasting damage to the substrate or any protective coating not being removed during the turbine component overhaul. Moreover, grit blasting cannot generally be used to remove oxide material from internal passage holes or cavities in the component.

Use of the oxide removal solution is advantageous in some situations, but also has drawbacks. For example, the use of two separate treatment solutions (one for removing the oxide and the other for removing the coating material) is not always desirable. A considerable amount of processing time is often involved, which can lower productivity in an industrial setting. Moreover, conventional treatment solutions which employ large quantities of strong mineral acids may emit an excessive amount of hazardous, acidic fumes. Due to environmental, health and safety concerns, such fumes must be scrubbed from ventilation exhaust systems.

Thus, new processes for removing oxide materials from coatings and/or from metal substrates would be welcome in the art. The processes should not result in the formation of an unacceptable amount of hazardous fumes. It would also be helpful if the processes were capable of removing a substantial amount of oxide material that might be located in indentations, hollow regions, or holes in the substrate, e.g., passage holes in a turbine engine substrate. Moreover, the processes should preferably be capable of being combined with other processing steps, such as a coating removal step.

SUMMARY OF THE INVENTION

A primary embodiment of this invention is directed to a method for removing an oxide material from the surface of a substrate or a coating disposed on the substrate. The method includes the step of contacting the oxide material with an aqueous composition which comprises an acid having the formula $H_xAF_6$, or precursors to said acid, wherein A is selected from the group consisting of Si, Ge, Ti, Zr, Al, and Ga; and x is 1–6. The acid is usually present at a level in the range of about 0.05 M to about 5 M, and is often either $H_2SiF_6$ or $H_2ZrF_6$, or mixtures thereof. Treatment is usually carried out by immersion in a bath of the aqueous composition. In some embodiments, the bath includes an additional acid, such as phosphoric acid, nitric acid, sulfuric acid, hydrochloric acid, hydrofluoric acid, and mixtures thereof.

Another aspect of the present invention is directed to a method for removing a coating from a substrate (e.g., a diffusion- or overlay coating), along with the oxide material which generally is disposed on top of the coating. The present inventors have discovered that the coating and the oxide material can be removed in a single step, by exposure to the same treatment composition, which is mentioned above and further described below. Moreover, the underlying substrate is not adversely affected by the treatment. Furthermore, in contrast to prior art techniques like grit blasting, the present method can be used to effectively remove oxide material from the internal sections of the substrate.

A method for replacing a worn or damaged protective coating applied over a substrate also constitutes part of the present invention. The method includes the step of cleaning the substrate by removing oxide material and coating material, using the treatment composition described below. A new protective coating is then applied to the substrate by various techniques.

Further details regarding the various features of this invention are found in the remainder of the specification.

DETAILED DESCRIPTION OF THE INVENTION

Figure 1:
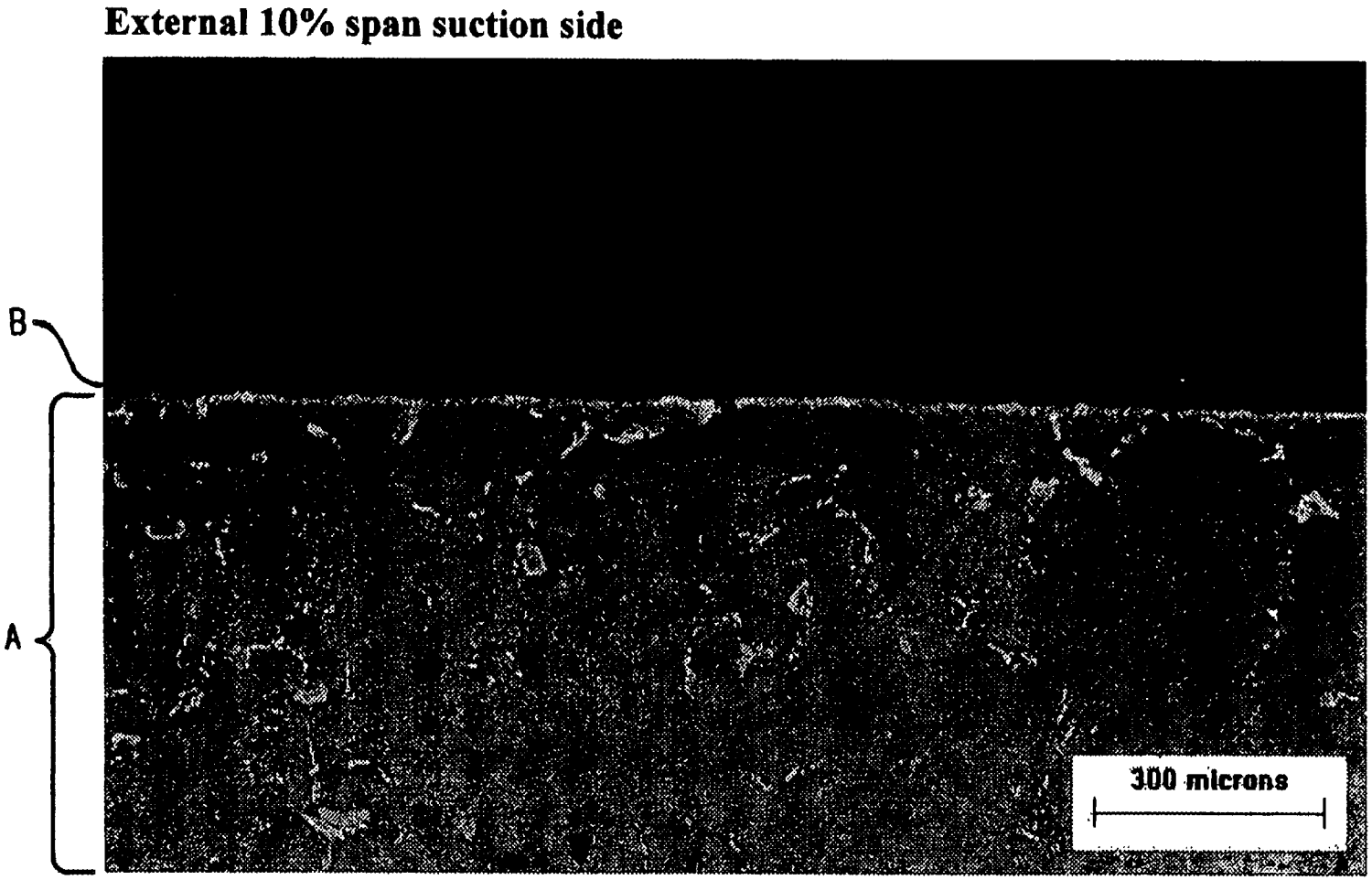
FIG. 1 is a cross-sectional view of an external portion of a turbine bucket, including a coating and oxidized material, after treatment according to this invention.

As alluded to earlier, the actual configuration of a substrate may vary widely. As a general illustration, the substrate may be in the form of a houseware item (e.g., cookware), or a printed circuit board substrate. Very often, the substrate is a turbine engine component, as further exemplified below.

As used herein, the term "oxide material" is generally meant to include the oxidized product or products of any metallic coating applied on a substrate, or the oxidized products of the substrate itself. In most cases (but not always), these products are formed on the coating after it has been exposed to the elevated temperatures mentioned above, i.e., about 1400° F. (760° C.) to about 2100° F. (1149° C.). Examples of the metallic coatings are diffusion coatings and overlay coatings, described above, and in patent application Ser. No. 09/591,531 of L. Kool et al, filed on Jun. 9, 2000, and incorporated herein by reference. (It should also be noted that the term "oxide" is meant to include the various phases of the oxide, e.g., alpha-alumina and alpha-chromia.)

The term "oxide material" also includes the oxidized product or products of the substrate material itself, in those locations where no coating is present. As an example, the surface of a nickel-based substrate exposed to elevated temperatures for extended periods of time will at least partially be transformed into various metal oxides (depending on the substrate's specific composition), such as aluminum oxide, chromium oxide, nickel oxide, cobalt oxide, and yttrium oxide. Various spinels may also form, such as $Ni(Cr,Al)_2O_4$ spinels and $Co(Cr,Al)_2O_4$ spinels. In the case of a platinum-nickel-aluminide coating, the oxidation product is primarily aluminum oxide (e.g., alpha-alumina and/or gamma alumina), and possibly nickel oxide.

The oxide material may be located in a variety of locations on a component, and is usually (but not always) formed over a protective coating, as described previously. In the case of a turbine engine, the oxide material is often formed on coatings which are applied on combustor liners, combustor domes, shrouds, or airfoils, including buckets or blades, and nozzles or vanes. The oxide material can be found on the flat areas of substrates, as well as on curved or irregular surfaces.

The oxide material is also formed on the surfaces of cavities in the substrates, e.g., indentations, hollow regions, or holes. For example, the cavities can be in the form of radial cooling holes or serpentine passageways, which can have an overall length of up to about 30 inches (76.2 cm). It is often very difficult to remove the oxide material from the surface of these cavities by conventional, line-of-sight processes, such as grit blasting, plasma etching, or laser ablation.

The thickness of the oxide material will depend on a variety of factors. These include the length of service time for the component; its thermal history; and the particular composition of the underlying coating (or substrate). Usually a layer of oxide material has a thickness in the range of about 0.5 micron to about 20 microns, and most often, in the range of about 1 micron to about 10 microns.

A variety of substrates may include the oxide material being removed according to this invention. Usually, the substrate is a metallic material or a polymeric (e.g., plastic) material. As used herein, "metallic" refers to substrates which are primarily formed of metal or metal alloys, but which may also include some non-metallic components. Non-limiting examples of metallic materials are those which comprise at least one element selected from the group consisting of iron, cobalt, nickel, aluminum, chromium, titanium, and mixtures which include any of the foregoing (e.g., stainless steel).

Very often, the metallic material is a superalloy, as described in the previously-referenced patent application, Ser. No. 09/591,531. The superalloy is typically nickel-, cobalt-, or iron-based, although nickel- and cobalt-based alloys are favored for high-performance applications. The base element, typically nickel or cobalt, is the single greatest element in the superalloy by weight. Illustrative nickel-base superalloys include at least about 40 wt % Ni, and at least one component from the group consisting of cobalt, chromium, aluminum, tungsten, molybdenum, titanium, and iron. Examples of nickel-base superalloys are designated by the trade names Inconel®, Nimonic®, and Rene®, and include directionally solidified and single crystal superalloys. Illustrative cobalt-base superalloys include at least about 30 wt % Co, and at least one component from the group consisting of nickel, chromium, aluminum, tungsten, molybdenum, titanium, and iron. Examples of cobalt-base superalloys are designated by the trade names Haynes®, Nozzaloy®, Stellite® and Ultimet®.

Polymeric substrates which can be treated by this invention are formed from materials which are substantially acid-resistant. In other words, such materials are not adversely affected by the action of the acid (or acids), to the degree which would make the substrate unsuitable for its intended end use. (Usually, such materials are highly resistant to hydrolysis). Non-limiting examples of such materials are polyolefins (e.g., polyethylene or polypropylene), polytetrafluoroethylenes, epoxy resins, polystyrenes, polyphenylene ethers; mixtures comprising one of the foregoing; and copolymers comprising one of the foregoing. Those skilled in the polymer arts understand that the properties of an individual polymer may be modified by various methods, e.g., blending or the addition of additives. (Oxide layers are not typically formed on polymeric materials, in the way that they are formed on metals. Thus, in the case of a polymeric substrate, the claimed process would usually be undertaken to remove oxide material from metallic coatings (e.g., aluminide) which have been deposited on top of the polymeric substrate.)

As mentioned above, the aqueous composition for some embodiments of this invention includes an acid having the formula $H_xAF_6$. In this formula, A is selected from the group consisting of Si, Ge, Ti, Zr, Al, and Ga. The subscript "x" is a quantity from 1 to 6, and more typically, from 1 to 3. Materials of this type are available commercially, or can be prepared without undue effort. The preferred acids are $H_2SiF_6$, $H_2ZrF_6$, or mixtures thereof. In some embodiments, $H_2SiF_6$ is especially preferred. The last-mentioned material is referred to by several names, such as "hydrofluosilicic acid", "fluorosilicic acid", and "hexafluorosilicic acid".

Precursors to the $H_xAF_6$ acid may also be used. As used herein, a "precursor" refers to any compound or group of compounds which can be combined to form the acid or its dianion $AF_6^{-2}$, or which can be transformed into the acid or its dianion under reactive conditions, e.g. the action of heat, agitation, catalysts, and the like. Thus, the acid can be formed in situ in a reaction vessel, for example.

As one illustration, the precursor may be a metal salt, inorganic salt, or an organic salt in which the dianion is ionically bound. Non-limiting examples include salts of Ag, Na, Ni, K, and $NH_4^+$, as well as organic salts, such as a quaternary ammonium salt. Dissociation of the salts in an aqueous solution yields the acid. In the case of $H_2SiF_6$, a convenient salt which can be employed is $Na_2SiF_6$.

Those skilled in the art are familiar with the use of compounds which cause the formation of $H_xAF_6$ within an aqueous composition. For example, $H_2SiF_6$ can be formed in situ by the reaction of a silicon-containing compound with a fluorine-containing compound. An exemplary silicon-containing compound is $SiO_2$, while an exemplary fluorine-containing compound is hydrofluoric acid (i.e., aqueous hydrogen fluoride, HF).

When used as a single acid, the $H_xAF_6$ acid appears to be somewhat effective for removing the oxide materials described above. The preferred level of acid employed will depend on various factors, such as the type and amount of oxide material being removed; the location of the oxide material on (or within) a substrate; the type of coating material and substrate; the thermal history of the coating material and substrate; the technique by which the oxide material is being exposed to the treatment composition (as described below); the time and temperature used for treatment; and the stability of the acid in solution.

In general, the $H_xAF_6$ acid is present in a treatment composition at a level in the range of about 0.05 M to about 5 M, where M represents molarity. (Molarity can be readily translated into weight or volume percentages, for ease in preparing the solutions). Usually, the level is in the range of about 0.2 M to about 3.5 M. In the case of $H_2SiF_6$, a preferred concentration range is often in the range of about 0.2 M to about 2.2 M. Adjustment of the amount of $H_xAF_6$ acid, and of other components described below, can readily be made by observing the effect of particular compositions on oxide removal from the underlying coating or substrate.

In some preferred embodiments, the aqueous composition may contain at least one additional acid, i.e., in addition to the "primary" acid, $H_xAF_6$. It appears that the use of the additional acid (the "secondary" acid or acids) often enhances the removal of oxide material from less accessible areas of the substrate. A variety of different acids can be used, and they are usually characterized by a pH less than about 7 in pure water. In preferred embodiments, the additional acid has a pH of less than about 3.5 in pure water. In some especially preferred embodiments, the additional acid has a pH which is less than the pH (in pure water) of the primary acid, i.e., the $H_xAF_6$ material. Thus, in the case of $H_2SiF_6$, the additional acid is preferably one having a pH less than about 1.3.

Various types of acids may be used, e.g., a mineral acid or an organic acid. Non-limiting examples include phosphoric acid, nitric acid, sulfuric acid, hydrochloric acid, hydrofluoric acid, hydrobromic acid, hydriodic acid, acetic acid, perchloric acid, phosphorous acid, phosphinic acid, alkyl sulfonic acids (e.g., methanesulfonic acid), and mixtures of any of the foregoing. (Sometimes, the acids are advantageously supplied and used in aqueous form, e.g., 35–38% hydrochloric acid in water). Those skilled in the art can select the most appropriate additional acid, based on observed effectiveness and other factors, such as availability, compatibility with the primary acid, cost, and environmental considerations. Moreover, a precursor of the acid may be used (e.g., a salt), as described above in reference to the primary acid. In some preferred embodiments of this invention, the additional acid is selected from the group consisting of phosphoric acid, nitric acid, sulfuric acid, hydrochloric acid, hydrofluoric acid, and mixtures thereof. In some especially preferred embodiments (e.g., when the primary acid is $H_2SiF_6$), the additional acid is phosphoric acid.

The amount of additional acid employed will depend on the identity of the primary acid, and on many of the factors set forth above. When used, the additional acid is preferably present at a level less than about 80 mole %, based on the total moles of acid present in the treatment composition. In some preferred embodiments, the additional acid is present at a level within the range of about 20 mole % to about 70 mole %. Furthermore, some especially preferred embodiments contemplate a range of about 20 mole % to about 35 mole %. As alluded to earlier, longer treatment times and/or higher treatment temperatures may compensate for lower levels of the acid, and vice versa. Experiments can be readily carried out to determine the most appropriate level for the additional acid. (The process of the present invention is generally free of the problems associated with prior art processes which required relatively large amounts of strong acids, as described previously).

The aqueous composition of the present invention may include various other additives which serve a variety of functions. Non-limiting examples of these additives are inhibitors, dispersants, surfactants, chelating agents, wetting agents, deflocculants, stabilizers, anti-settling agents, reducing agents, and anti-foam agents. Those of ordinary skill in the art are familiar with specific types of such additives, and with effective levels for their use. An example of an inhibitor for the composition is a relatively weak acid like acetic acid, mentioned above. Such a material tends to lower the activity of the primary acid in the composition. This is desirable in some instances, e.g., to decrease the potential for pitting of the substrate surface if it is contacted with the treatment composition.

Various techniques can be used to treat the substrate with the aqueous composition. For example, the substrate can be continuously sprayed with the composition, using various types of spray guns. A single spray gun could be employed. Alternatively, a line of guns could be used, and the substrate could pass alongside or through the line of guns (or multiple lines of guns). In another alternative embodiment, the oxide-removal composition could be poured over the substrate (and continuously recirculated).

In preferred embodiments, the substrate is immersed in a bath of the aqueous composition. Immersion in this manner (in any type of vessel) often permits the greatest degree of contact between the aqueous composition and the oxide material being removed. Immersion time and bath temperature will depend on many of the factors described above, such as the type of oxide being removed, and the acid (or acids) being used in the bath. Usually, the bath is maintained at a temperature in the range of about room temperature to about 100° C., while the substrate is immersed therein. In preferred embodiments, the temperature is maintained in the range of about 45° C. to about 90° C. The immersion time may vary considerably, but is usually in the range of about 10 minutes to about 72 hours, and preferably, from about 1 hour to about 20 hours. Longer immersion times may compensate for lower bath temperatures. After removal from the bath (or after contact of the coating by any technique mentioned above), the substrate is typically rinsed in water, which also may contain other conventional additives, such as a wetting agent.

An important advantage of the present invention is that an oxide material can be removed from a coating in the same step that the coating is being removed from an underlying substrate. For example, exposure of the substrate to a treatment solution as described above removes substantially all of the oxide material, and then removes substantially all of the coating, e.g., a diffusion or overlay coating. Details regarding the removal of these types of coatings from metal or polymeric substrates are set forth in the above-referenced patent application, Ser. No. 09/591,531.

Thus, another embodiment of this invention is directed to a method for cleaning a substrate, i.e., removing substantially all oxide material and coating material from its surface. The method comprises exposing the substrate to a treatment composition (as described previously), under conditions sufficient to remove the oxide material and any coating material. In general, the oxide material is stripped first, followed by removal of the underlying coating. However, there may be some overlap, i.e., portions of the oxide material and coating material may be removed from the substrate simultaneously.

The period of time required to remove both the oxide material and the coating from a substrate will vary substantially, depending on the factors set forth above, e.g., the composition and thickness of the oxide material and coating material; as well as the temperature of the treatment composition. In general, the time period will be within about 10% to about 50% greater than the time period needed for a single treatment, if the treatments were carried out in two separate steps, e.g., in two separate stripping baths. For example, in the case of an oxidized aluminide or platinum-aluminide coating having a total thickness in the range of about 5 microns to about 10 microns, the overall treatment time will usually be in the range of about 10 minutes to about 20 hours. The bath temperature is usually maintained within the range described previously.

Another aspect of the present invention is directed to a method for replacing a worn or damaged protective coating applied over a substrate. As mentioned earlier, oxides form on metallic coatings which have been in service, e.g., turbine engine components. These oxides have to be removed before the underlying coating can be repaired or replaced. Thus, the method comprises the following steps:

(i) removing an oxide material from the surface of a coating disposed on the substrate, by contacting the oxide material with an aqueous composition which comprises an acid having the formula $H_xAF_6$, or precursors to said acid, wherein A is selected from the group consisting of Si, Ge, Ti, Zr, Al, and Ga; and x is 1–6;

(ii) removing the coating disposed on the substrate, by contacting the coating with an aqueous composition which comprises an acid having the formula $H_xAF_6$, or precursors to said acid, wherein A is selected from the group consisting of Si, Ge, Ti, Zr, Al, and Ga; and x is 1–6; and then (iii) applying a new coating to the substrate.

As described earlier, the same aqueous composition can be used for steps (i) and (ii). Moreover, techniques for applying the new coating are well-known in the art. As an example, various thermal spray techniques can be employed for the deposition of the overlay coatings. Examples include vacuum plasma spray (VPS), air plasma spray (APS), and high velocity oxy-fuel (HVOF). Other deposition techniques could be used as well, such as sputtering and physical vapor deposition (PVD), e.g., electron beam physical vapor deposition (EB-PVD).

Various techniques are also well-known for applying diffusion coatings, e.g., noble metal-aluminide coatings such as platinum-aluminide or palladium-aluminide. As an example in the case of platinum-aluminide, platinum can initially be electroplated onto the substrate, using P-salt or Q-salt electroplating solutions. In a second step, the platinum layer is diffusion-treated with aluminum vapor to form the platinum-aluminide coating. This technique is sometimes referred to as "diffusion-aluminiding".

The examples which follow are merely illustrative, and should not be construed to be any sort of limitation on the scope of the claimed invention.

EXAMPLE 1

The substrate for this example was a gas turbine bucket formed from a directionally-solidified, nickel-base superalloy. The bucket included a number of cavities, most of which were in the shape of serpentine passage holes, forming a cooling circuit. The bucket had initially been coated by VPS with an MCrAlY-type material, having an approximate, nominal composition as follows: 29 wt % Cr, 6 wt % Al, 1 wt % Y, balance Co. The coating was applied by a thermal spray technique, to a thickness of about 250 microns. The coated surface was then diffusion-aluminided to a depth of about 50 microns. The cavities were also diffusion-aluminided.

The gas turbine bucket had a service life of about 24,000 hours. This exposure resulted in oxide formation on the coating, in both external regions and internal (i.e., within passage holes) regions. The oxide depth varied to some extent, but was generally in the range of about 1 micron to about 10 microns.

The bucket was immersed in a solution of 75 volume % fluorosilicic acid ($H_2SiF_6$, at 23 wt % concentration) and 25 volume % phosphoric acid (86 wt % concentration), and vigorously stirred at 70° C. After 13 hours, the oxide and coating material had been stripped from both external and internal surfaces.

FIG. 1 is a photomicrograph of an external cross-section of a portion of the turbine bucket after treatment according to this invention. (The grain structure of the metallic cross-section has been highlighted, using a grain etch.) The figure depicts the "suction side" of the bucket's 10% span. Section A is the substrate, while section B is a depletion zone, i.e., the zone where the aluminum has actually been depleted from the base metal.

Figure 2:
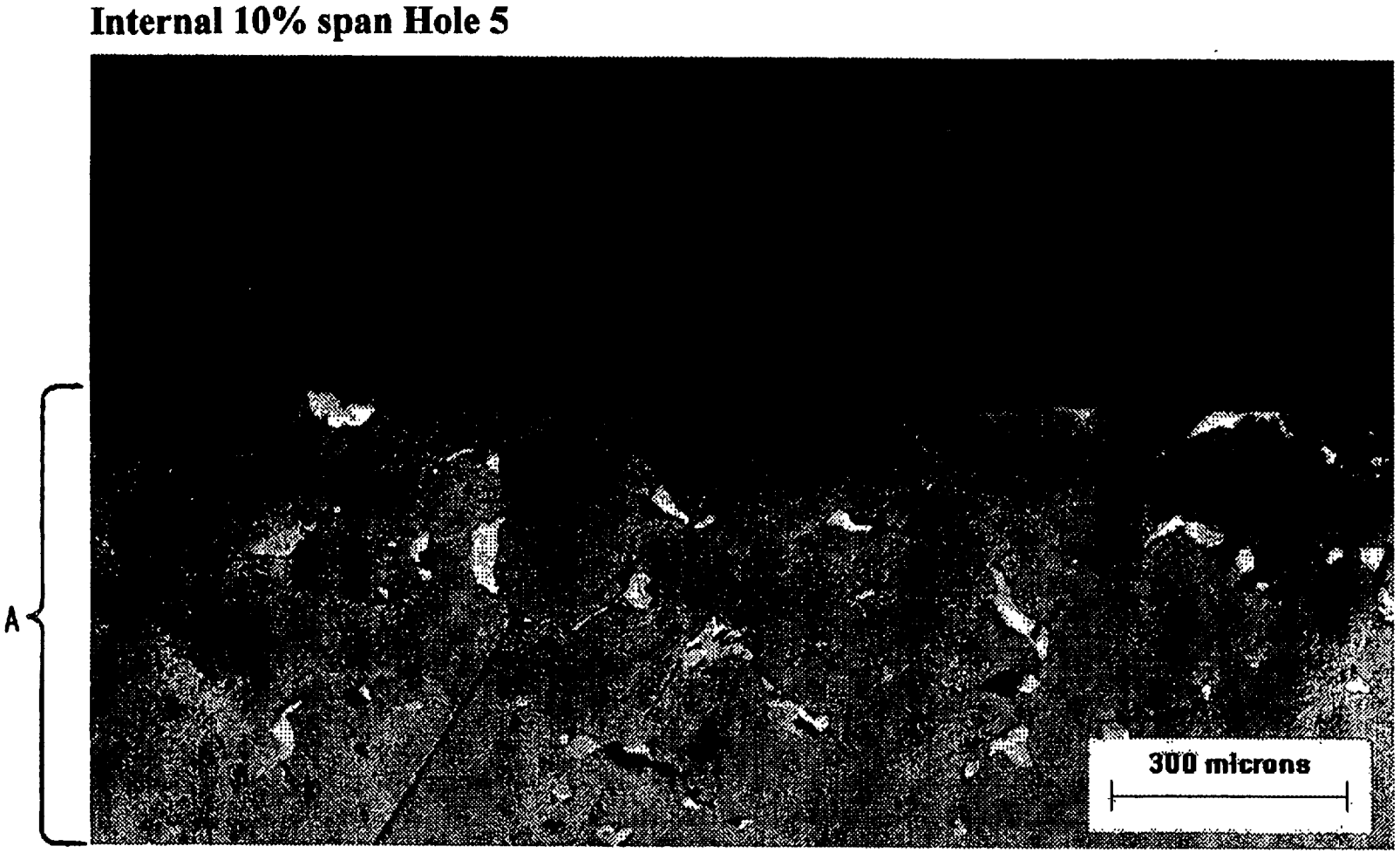
FIG. 2 is a cross-sectional view of an internal portion of a coated and oxidized turbine bucket, after treatment according to this invention.

FIG. 2 is a photomicrograph of an internal cross-section of a portion of the turbine bucket after treatment is complete. The figure depicts a section of a passage hole, with section A showing the substrate. The areas marked as elements "C" in this figure are the eutectic phase . The eutectic phase is often present in this type of substrate metal, and is very susceptible to attack by conventional stripping techniques, e.g., using strong mineral acids.

Figure 3:
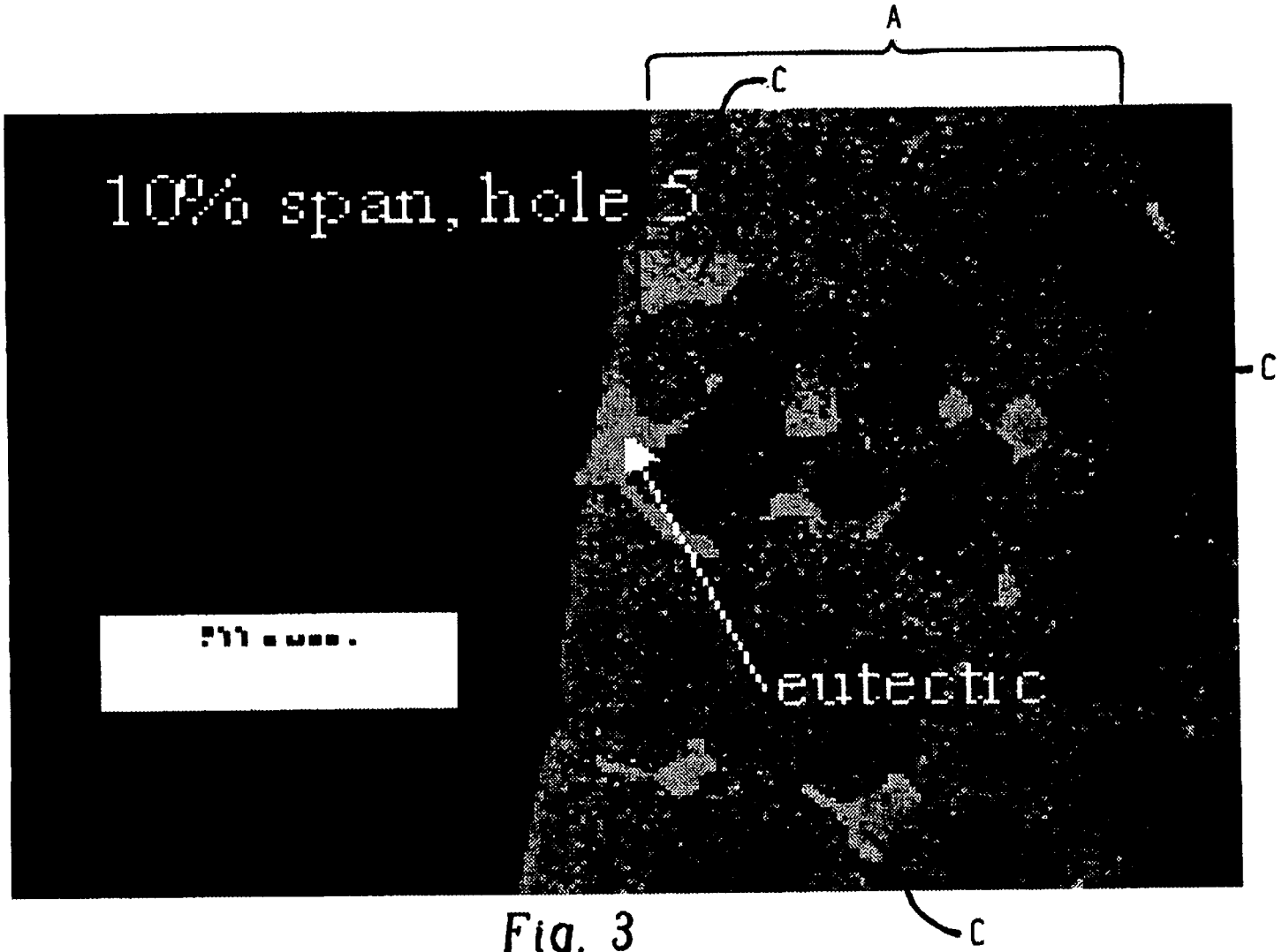
FIG. 3 is a cross-sectional view of another section of an internal portion of a coated and oxidized turbine bucket, after treatment according to this invention.

FIG. 3 is a photomicrograph of an internal cross-section of another portion of the turbine bucket after the completion of treatment. (The orientation is vertical in this figure, with section A again depicting the substrate). This figure also demonstrates substantially complete removal of the oxide and coating. Moreover, the treatment did not result in detrimental attack on the eutectic phase C.

EXAMPLE 2

In this experiment, the substrate was a sample coupon of a directionally-solidified, nickel-base superalloy material similar to the bucket composition described in Example 1. The coupon was coated by HVOF with the MCrAlY material described in the previous example (coating depth of about 200 to 300 microns), and then over-aluminided in a similar manner.

The coupon was heated at 2050° F. (1121° C.) in air for 47 hours, in order to simulate the oxidation that would occur under normal operating conditions. The coupon was then immersed in a treatment bath identical to that described in Example 1. The coupon was removed from the bath for sampling at periodic intervals.

Figure 4:
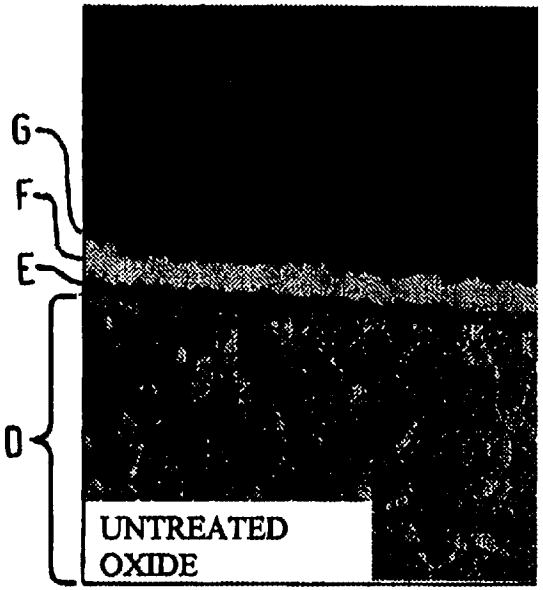
FIG. 4 is a cross-sectional view of a sample coupon which includes a coating and oxide material.
Figure 5:
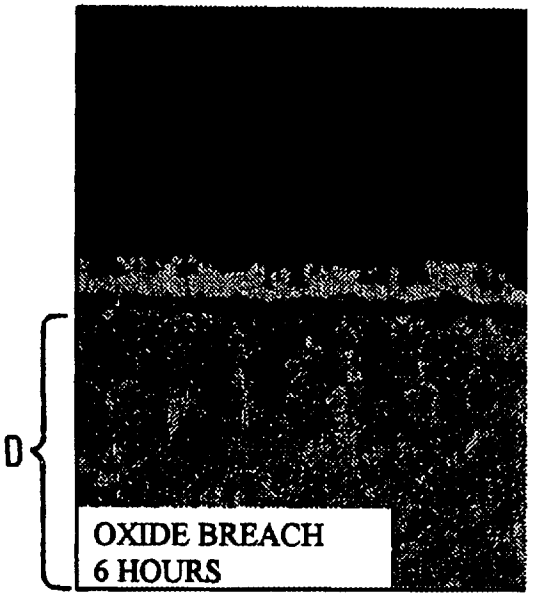
FIG. 5 is a cross-sectional view of the coupon of FIG. 4, after partial treatment according to the present invention.
Figure 6:
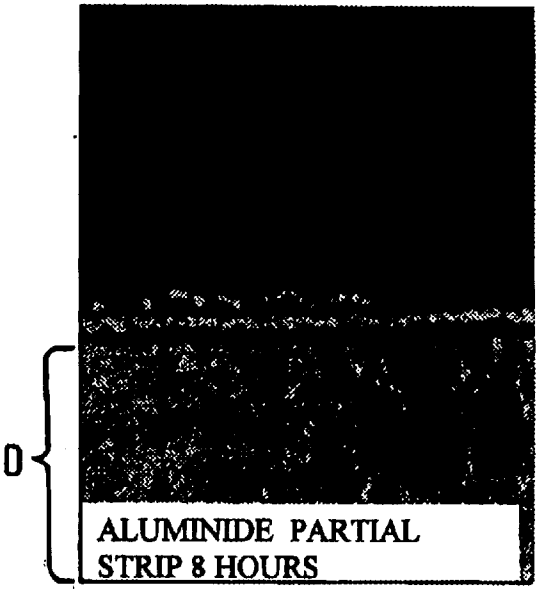
FIG. 6 is a cross-sectional view of the coupon of FIG. 5, after further treatment according to the present invention.

In FIGS. 4–6, element D delineates the substrate. In FIG. 4, section E is a diffusion zone, while section F is the oxide material. The thin line of material designated as element G is the over-aluminided coating material, although the distinction between "oxide" and "coating" is not especially clear after severe oxidation has occurred.

FIGS. 5 and 6 demonstrate progressive dissolution of the oxide material at treatment times of 6 hours and 8 hours, respectively. FIG. 6 shows substantially complete removal of the oxide material, with only residual material remaining. This residual material is very porous, and easily-removed at this stage.

Some of the preferred embodiments have been set forth in this disclosure for the purpose of illustration. However, the foregoing description should not be deemed to be a limitation on the scope of the invention. Accordingly, various modifications, adaptations, and alternatives may occur to one skilled in the art without departing from the spirit and scope of the claimed inventive concept.

All of the patents, articles, and texts mentioned above are incorporated herein by reference.

What is claimed:

1. A method for removing at least one of: (1) an oxidized product of a substrate from a surface of the substrate, wherein the substrate is a turbine component formed of an alloy selected from the group consisting of a nickel based alloy, a cobalt based alloy, and an iron based alloy, or (2) an oxidized product of a metallic coating disposed on the substrate from a surface of the metallic coating, wherein the substrate is the turbine component formed of the alloy, the method comprising the step of contacting the oxidized product of the substrate or the oxidized product of the metallic coating with an aqueous composition to remove a predetermined amount of the oxidized product of the substrate or a predetermined amount of the oxidized product of the metallic coating, wherein the aqueous composition consists essentially of an acid having the formula $H_xAF_6$ and water, wherein A is selected from the group consisting of Si, Ge, Ti, and Ga; and x is 1–6.

2. The method of claim 1, wherein x is 1–3.

3. The method of claim 1, wherein the acid is present at a level in the range of about 0.05 M to about 5 M.

4. The method of claim 3, wherein the acid is present at a level in the range of about 0.2 M to about 3.5 M.

5. The method of claim 1, wherein the aqueous composition is $H_2SiF_6$.

6. A method for removing at least one of an oxidized product of a substrate from a surface of the substrate, wherein the substrate is a turbine component formed of an alloy selected from the group consisting of a nickel based alloy, a cobalt based alloy, and an iron based alloy an alloy comprising nickel, chromium, aluminum, or at least one of the foregoing metals, or a polymer, or an oxidized product of a metallic coating disposed on the substrate from a surface of the metallic coating, wherein the substrate is the turbine component formed of the alloy, the method comprising the step of contacting the oxidized product of the substrate or the oxidized product of the metallic coating with an aqueous composition to remove a predetermined amount of the oxidized product of the substrate or a predetermined amount of the oxidized product of the metallic coating, wherein the aqueous composition consists essentially of an acid having the formula $H_xAF_6$, at least one additional acid, and water, wherein A is selected from the group consisting of Si, Ge, Ti, and Ga; and x is 1–6.

7. The method of claim 6, wherein the at least one additional acid has a pH of less than about 7 in water.

8. The method of claim 7, wherein the at least one additional acid has a pH of less than about 3.5 in water.

9. The method of claim 6, wherein the at least one additional acid is a mineral acid.

10. The method of claim 6, wherein the at least one additional acid is selected from the group consisting of phosphoric acid, nitric acid, sulfuric acid, hydrochloric acid, hydrofluoric acid, hydrobromic acid, hydriodic acid, acetic acid, perchloric acid, phosphorous acid, phosphinic acid, alkyl sulfonic acids, and mixtures of any of the foregoing.

11. The method of claim 6, wherein the at least one additional acid is phosphoric acid.

12. The method of claim 6, wherein the at least one additional acid is present at a level less than about 80 mole %, based on the total moles of acid present in the aqueous composition.

13. The method of claim 12, wherein the at least one additional acid is present at a level of about 20 mole % to about 70 mole %.

14. The method of claim 1, wherein the oxide material is treated in a bath of the aqueous composition.

15. The method of claim 14, wherein the bath is maintained at a temperature in the range of about room temperature to about 100° C., during treatment.

16. The method of claim 15, wherein the temperature is in the range of about 45° C. to about 90° C.

17. The method of claim 15, wherein the treatment time is in the range of about 10 minutes to about 72 hours.

18. The method of claim 17, wherein the treatment time is in the range of about 60 minutes to about 20 hours.

19. A method for removing at least one of: (1) an oxidized product of a substrate from a surface of the substrate, wherein the substrate is a turbine component formed of an alloy selected from the group consisting of a nickel based alloy, a cobalt based alloy, and an iron based alloy, or (2) an oxidized product of a metallic coating disposed on the substrate from a surface of the metallic coating, wherein the substrate is the turbine component formed of the alloy, the method comprising the step of exposing the oxidized product of the substrate or the oxidized product of the metallic coating to an aqueous composition to remove a predetermined amount of the oxidized product of the substrate or a predetermined amount of the oxidized product of the metallic coating, wherein the aqueous composition consists essentially of an acid having the formula $H_xAF_6$ and water, wherein A is selected from the group consisting of Si, Ge, Ti, and Ga; and x is 1–6, and wherein the precursors to said acid comprise any compound or group of compounds which can be combined to form the acid or its dianion $AF_6^{-2}$.

20. A method for removing an oxide material from a diffusion- or overlay coating on the surface of a turbine engine component, comprising the step of contacting the oxide material with an aqueous composition to selectively remove the oxide material from the diffusion or the overlay coating, wherein the aqueous composition comprises $H_2SiF_6$, wherein the diffusion coating comprises an aluminide alloy, and wherein the overlay coating comprises a composition having a formula of MCrAl(X), wherein M is an element selected from the group consisting of Ni, Co, Fe, and combinations thereof, and wherein X is an element selected from the group consisting of Y, Ta, Si, Hf, Ti, Zr, B, C, and combinations thereof.

21. The method of claim 20, wherein the aqueous composition further comprises an additional acid selected from the group consisting of phosphoric acid, nitric acid, sulfuric acid, hydrochloric acid, hydrofluoric acid, and mixtures thereof, wherein the additional acid is present at a level less than about 80 mole %, based on the total moles of acid present in the aqueous composition.

22. The method of claim 20, wherein the oxide material is also initially present in at least one cavity within the turbine engine component, and is removed therefrom during treatment with the aqueous composition.

23. A method for replacing a protective coating applied over a substrate, comprising the following steps:

(i) removing an oxide material from a surface of the protective coating disposed on the substrate by contacting the oxide material with an aqueous composition which comprises an acid having the formula $H_xAF_6$, or precursors to said acid, wherein A is selected from the group consisting of Si, Ge, Ti, and Ga; and x is 1–6;

(ii) removing the protective coating disposed on the substrate by contacting the protective coating with the aqueous composition; and (iii) applying a new protective coating to the substrate.

24. The method of claim 23, wherein steps (i) and (ii) are carried out simultaneously, using the same aqueous composition.

25. The method of claim 24, wherein the aqueous composition further comprises at least one additional acid or precursor thereof.

26. The method of claim 25, wherein the additional acid is selected from the group consisting of phosphoric acid, nitric acid, sulfuric acid, hydrochloric acid, hydrofluoric acid, hydrobromic acid, hydriodic acid, acetic acid, perchloric acid, phosphorous acid, phosphinic acid, alkyl sulfonic acids, and mixtures of any of the foregoing.

27. The method of claim 23, wherein the coating removed in step (ii) and the coating applied in step (iii) are each selected from the group consisting of diffusion coatings and overlay coatings.

28. The method of claim 23, wherein the new coating of step (iii) is applied by a technique selected from the group consisting of vacuum plasma spray (VPS); air plasma spray (APS); high velocity oxy-fuel (HVOF); sputtering; physical vapor deposition (PVD); electron beam physical vapor deposition (EB-PVD); and diffusion-aluminiding.

* * * * *